US007121112B2

(12) United States Patent
Robertson

(10) Patent No.: US 7,121,112 B2
(45) Date of Patent: Oct. 17, 2006

(54) COUNTER TOP COOLER WITH INDIVIDUAL CONTAINER POCKETS

(75) Inventor: James David Robertson, Atlanta, GA (US)

(73) Assignee: Display Industries, LLC., Norcross, GA (US)

( * ) Notice: Subject to any disclaimer, the term of this patent is extended or adjusted under 35 U.S.C. 154(b) by 0 days.

(21) Appl. No.: 11/191,546

(22) Filed: Jul. 28, 2005

(65) Prior Publication Data

US 2006/0168993 A1 Aug. 3, 2006

Related U.S. Application Data

(63) Continuation-in-part of application No. 11/047,031, filed on Jan. 31, 2005.

(51) Int. Cl.
*F25D 3/08* (2006.01)

(52) U.S. Cl. ..... 62/457.5; 62/457.4

(58) Field of Classification Search ..... 62/457.4, 62/457.5, 45

See application file for complete search history.

(56) References Cited

U.S. PATENT DOCUMENTS 4,899,553 A * 2/1990 Drummond, III ..... 62/372
6,067,816 A * 5/2000 Hodosh ..... 62/457.4
6,481,014 B1 * 11/2002 Banks et al. ..... 220/592.17
6,564,992 B1 * 5/2003 Wegner ..... 229/117.35
2002/0112501 A1 * 8/2002 Williams, Jr. ..... 62/457.4
2003/0213263 A1 * 11/2003 Woog ..... 62/457.7
2004/0025530 A1 * 2/2004 Perrins ..... 62/457.5
2004/0093892 A1 * 5/2004 Abfalter ..... 62/457.7

* cited by examiner

*Primary Examiner*—Cheryl Tyler
*Assistant Examiner*—B. Clayton McCraw
(74) *Attorney, Agent, or Firm*—John L. James

(57) ABSTRACT

A cooler for a counter top has a bottom panel having lateral and transverse edge portions and a plurality of upright panels attached thereto and extending upward therefrom forming a vessel with an interior adapted to hold ice. The plurality of upright panels includes a front panel having a front surface and plurality of pockets extending from the front surface to the interior of the vessel. An access panel provides access to the interior for filling the cooler with ice. The ice cools each pocket to thereby chill a beverage container resting in the pocket.

3 Claims, 4 Drawing Sheets

COUNTER TOP COOLER WITH INDIVIDUAL CONTAINER POCKETS

CROSS REFERENCE TO RELATED APPLICATIONS

This application is a continuation in part of application Ser. No. 11/047,031 filed Jan. 31, 2005 entitled Cooler With Individual Container Pockets.

TECHNICAL FIELD OF THE INVENTION

This invention relates generally to a cooler, and, more particularly, to a cooler for beverage containers for use with ice.

BACKGROUND OF THE INVENTION

Coolers for use with ice are used in convenience stores and other commercial environments to place containers of beverages for easy access by consumers. Ice coolers typically take the form of a barrel or chest positioned near a store entrance, near the cash register, at the end of an isle or other locations to spur an impulse purchase. These containers are filled with ice and the beverage containers are placed on the ice and onto the ice. As the ice melts, the beverage containers sink forcing a consumer to fish around in the ice for the desired container. In addition to having a cold, wet hand, which is unpleasant, the consumer is sometimes exposed to germ-laden water. Barrel and chest coolers do have the advantage of placing the beverage containers within easy reach of a consumer at waist level instead of at eye level. It is desirable to have a cooler wherein melting ice does not touch the beverage containers and contaminate the water or containers.

Chest and barrel coolers are generally unsuitable for use on a checkout counter. Barrel coolers are generally to tall and chest coolers are generally too bulky. Both obscure the beverage containers. It is desirable to have a cooler that is not bulky and keeps beverage containers visible to spur impulse purchases.

Another problem with chest and barrel coolers is the inability to remove a single container without disturbing remaining containers in the icy water. It is therefore desirable to have a cooler wherein containers can be removed, one at a time, without disturbing the remaining containers.

SUMMARY OF THE INVENTION

The present invention is directed to overcoming one or more of the problems set forth above. Briefly summarized, according to one aspect of the present invention, a cooler comprises a base member and an upper member connected to the base member forming a vessel with an interior adapted to hold fluid. The upper member has an outer surface with an access opening and plurality of pockets extending from the outer surface into the interior of the vessel. An access panel is disposed over the access opening.

The pockets allow an individual container to be inserted or removed without disturbing the other containers. The pockets isolate the container from the ice and water so that the containers are not wet by the water and there is no possibility of contamination. Because the containers are isolated from the ice and water, the water does not wet the hand of a consumer when the consumer removes a container.

According to another aspect of the invention, a cooler comprises a bottom panel having lateral and transverse edge portions and a plurality of upright panels connected thereto and extending upward therefrom forming a vessel with an interior adapted to hold fluid. A top panel in connected to the upright panels, and has a surface and plurality of pockets extending from the surface into the interior of the vessel.

The pockets can be of different sizes so that a single cooler can hold several brands and sizes of containers. A portion of a container can extend beyond the surface of the cooler to aid in product identification and selection.

According to yet another aspect of the invention, a cooler comprises a bottom panel having a plurality of edge portions. A sidewall is connected to the bottom panel. The sidewall and bottom panel form a vessel adapted to hold fluid. A top panel is connected to the sidewall and spaced from the bottom panel. The top panel has a plurality of openings. A plurality of pockets extend from the plurality of openings in the top panel into the interior. When the vessel is filled with ice, the pockets are cooled thereby cooling containers in the pockets.

These and other aspects, objects, features and advantages of the present invention will be more clearly understood and appreciated from a review of the following detailed description of the preferred embodiments and appended claims, and by reference to the accompanying drawings wherein similar reference numerals have been used, where possible, to designate similar or identical features that are common to the figures.

DETAILED DESCRIPTION OF THE PREFERRED EMBODIMENTS

Figure 1:
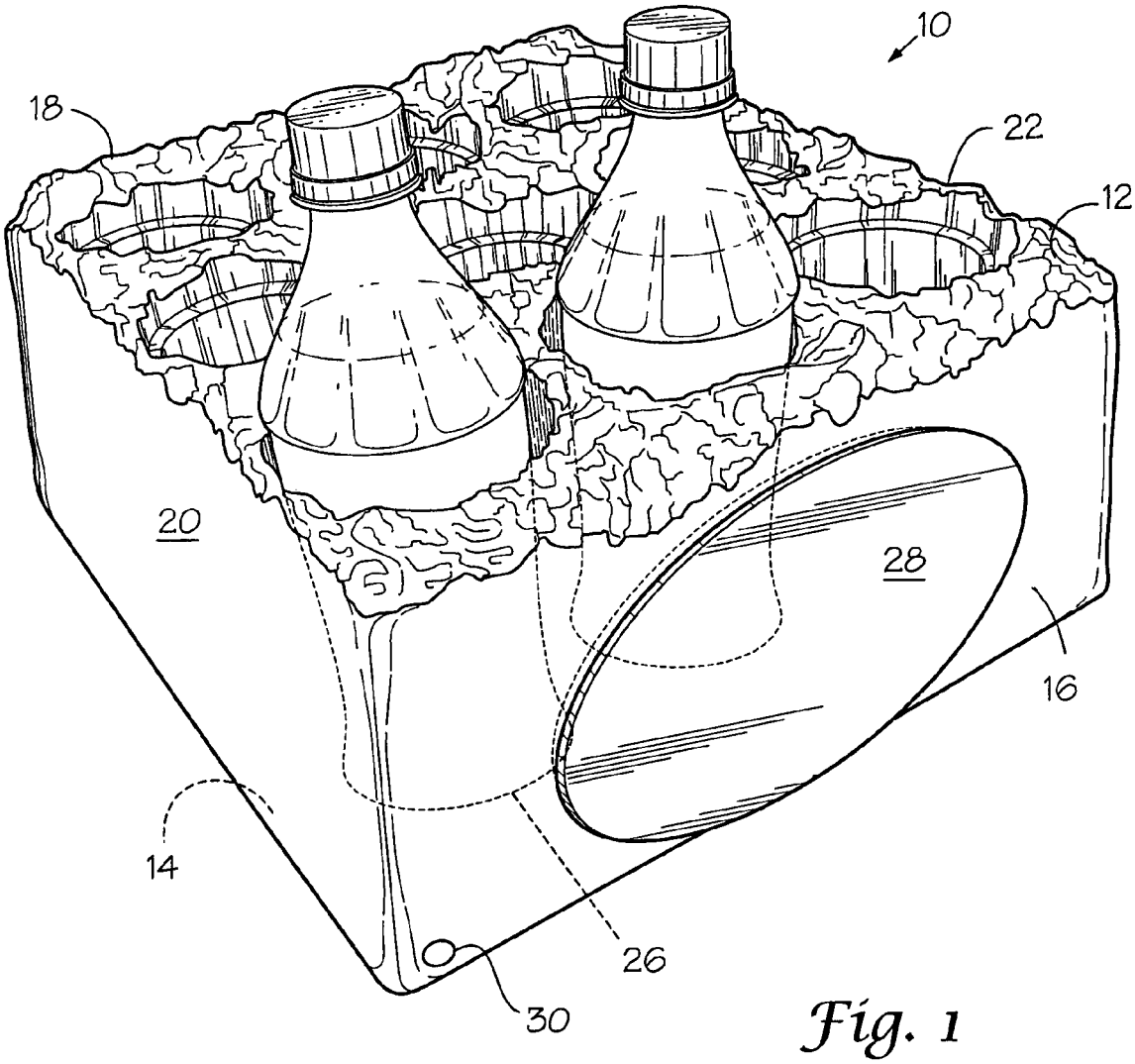
FIG. 1 is a perspective view of a preferred embodiment of a cooler with pockets for containers according to the present invention.
Figure 2:
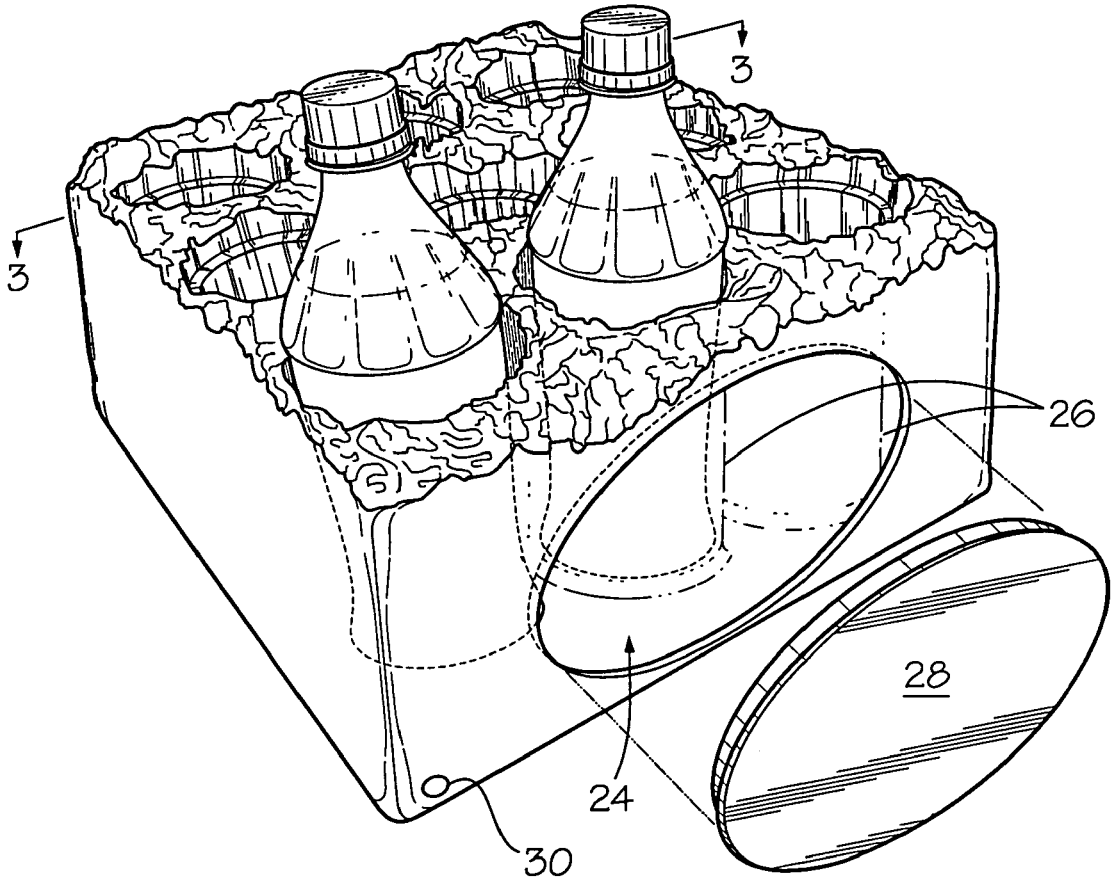
FIG. 2 is a perspective view of the cooler of FIG. 1 with an access panel removed.
Figure 3:
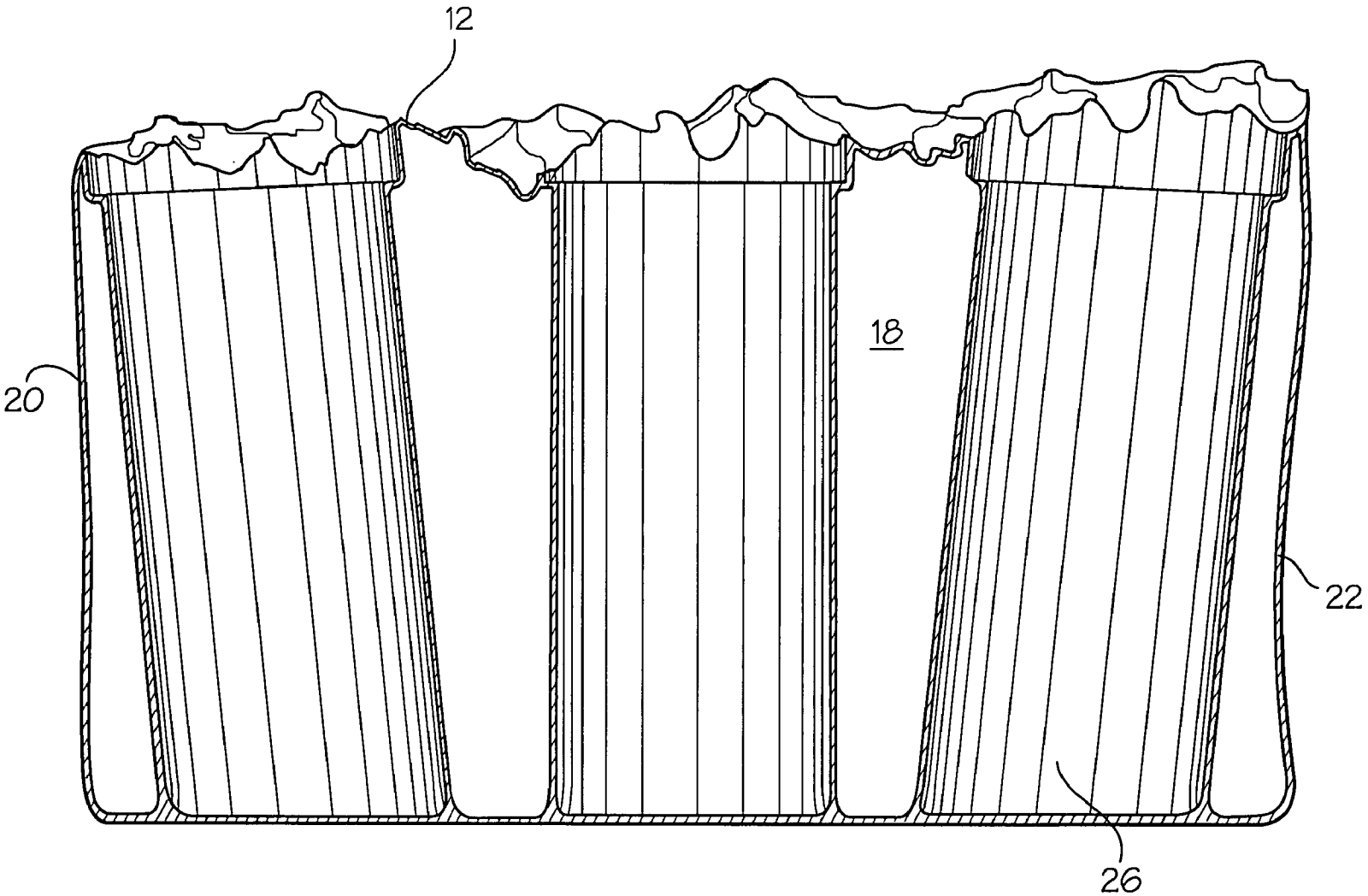
FIG. 3 is a sectional view taken along line 3—3 of FIG. 2.
Figure 4:
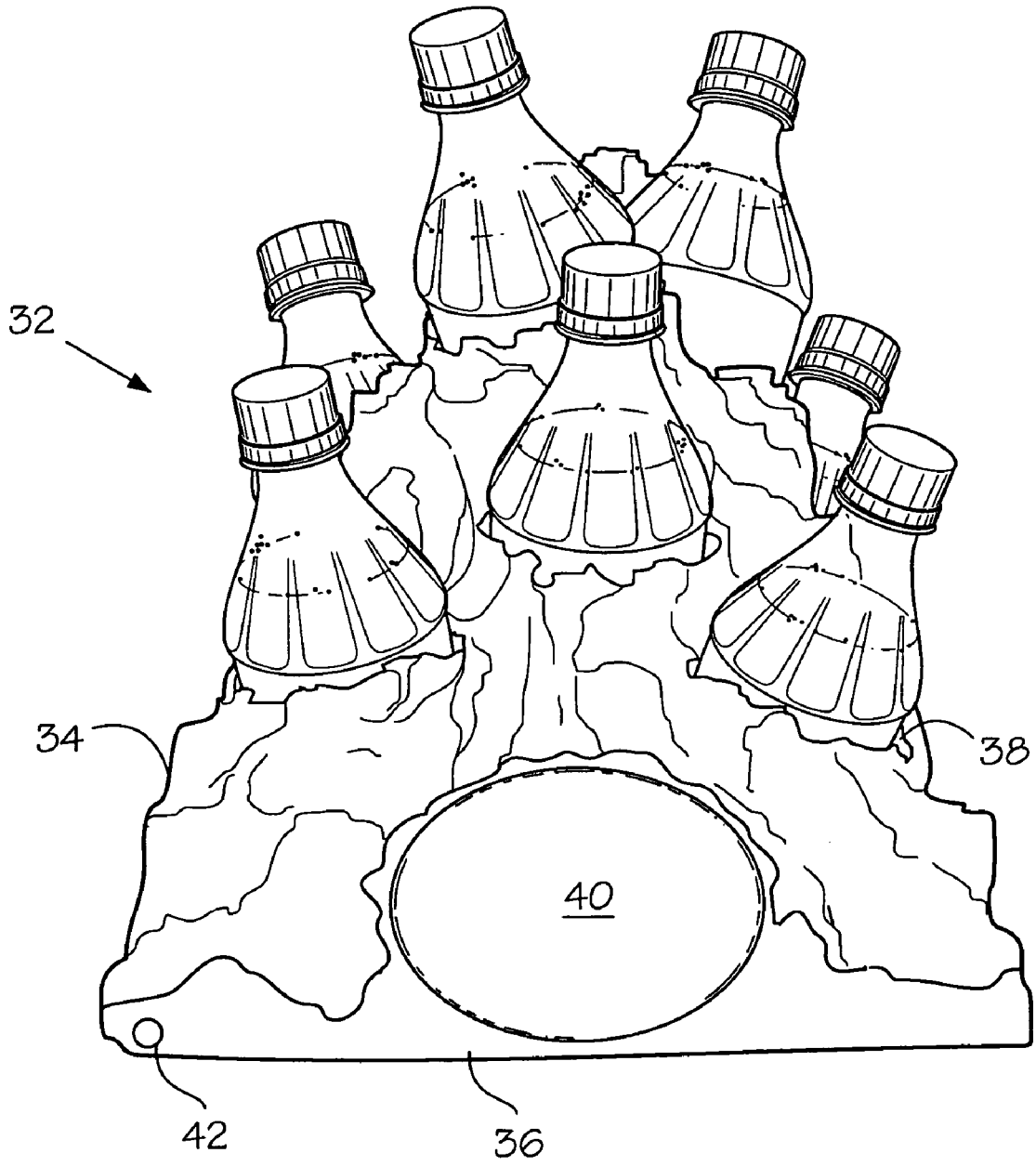
FIG. 4 is a perspective view of another preferred embodiment of a cooler according to the present invention featuring an irregular configuration.

Referring to FIGS. 1–3, a cooler 10 is provided for cooling beverage containers or other items. Cooler 10 has a top panel 12, a base or bottom panel 14 and a plurality of side or upright panels forming a vessel capable of holding water. Bottom panel 14 has lateral and transverse edge portions and is polygonal shaped. Preferably bottom panel 14 is rectangular in shape with a front, rear and side edge portions, but may be triangular or other shapes (FIG. 4).

The plurality of upright panels includes a front panel 16 attached to bottom panel 14 and extending upward therefrom. Similarly a rear panel 18 and end panels 20, 22 also attach to bottom panel 14 and extend upward therefrom forming a vessel with an interior 24 adapted to hold fluid or ice. Naturally, the number of upright panels will match the number of edge portions of bottom panel 14.

Top panel 12 has an exterior top surface with a plurality of openings and plurality of pockets 26 extending from the openings in the exterior top surface to the interior 24 of the vessel. The top surface is preferably crinkly like the surface of a block of ice. The side panels can be crinkly also. Pockets 26 may extend to bottom panel 14 and be integrally formed therewith, or may only extend a distance sufficient to accommodate a container for cooling.

Pockets 26 are shown arranged in rows and columns but may be arranged in any order, and each pocket is preferably spaced from adjacent pockets to facilitate contact with the cooling medium. While a square cooler is shown, rectangular coolers can be used. An advantage of rectangular coolers is that two or more coolers can be arranged side by side to fit whatever counter space is available. Pockets 26 may be oriented vertically or angled from vertical to present a more aesthetic display or to more favorably display product or product labeling.

Still referring to FIGS. 1–3, cooler 10 has an access panel 28 removably attached over an opening in one of the upstanding panels 16, 18, 20, 22 to provide access to the interior 24 of the cooler for adding ice for cooling. When added, ice will fill some of the spaces between the pockets. As the ice melts, water will fill voids between pockets and provide contact for heat transfer from the pockets. As the pockets cool, the containers in the pockets will also cool. To retard heat loss through the upright panels, interior panel surfaces not having a pocket can be insulated with foam, double walled construction, or a spray on insulating coating. In addition, the portions of the pockets immediately adjacent an insulated surface may also be insulated. It has been found manufacturing the cooler by a blow mold process allows double-walled construction with insulating properties that retard melting of the ice.

A drain 30 disposed in an opening in the bottom panel 14, or, more preferably in an opening in a bottom portion of an upstanding sidewall panel 16, 18, 20, 22 of the vessel is used to drain the vessel. To aid drainage, a perforated drain pipe disposed along or near the bottom of the cooler may be used to channel water to the drain. When the ice melts and the vessel is filled with water, it is time to drain the water. Water may be drained at other times as is convenient. Because the cooler can be small to fit on a counter top, plumbing or drain hoses are not required. The entire unit can be easily carried about.

Referring to FIG. 4, a cooler 32 is provided for cooling beverage containers or other items. Cooler 32 has a top panel 34 and a base or bottom panel 36 forming a vessel capable of holding water. Bottom panel 36 is shown triangular in shape but can have any configuration.

Top panel 34 has an exterior top surface with a plurality of openings and a plurality of pockets 38 extending from the openings in the exterior top surface to the interior of the vessel. The top surface is preferably crinkly like the surface of a block of ice. The side panels can be crinkly also. Pockets 38 may extend to bottom panel 36 and be integrally formed therewith, or may only extend a distance sufficient to accommodate a container for cooling. Pockets 38 are shown arranged in a random order instead of neat. Each pocket is preferably spaced from adjacent pockets to facilitate contact with the cooling medium. Pockets 38 may be oriented vertically or angled from vertical to present a more aesthetic display or to more favorably display product or product labeling.

Cooler 32 has an access panel 30 removably attached over an opening in one of the top and bottom panels 34, 36 to provide access to the interior of the cooler for adding ice for cooling.

A drain 42, disposed in an opening in the bottom panel 14, or, more preferably in an opening in a lower portion of the top panel 34 of the vessel, is used to drain the vessel.

While the invention has been described with particular reference to the preferred embodiments, it will be understood by those skilled in the art that various changes may be made and equivalents may be substituted for elements of the preferred embodiments without departing from invention. For example, the pockets can be arranged to resemble the contour of familiar beverage containers instead of the rows and columns illustrated. Also, while ice and onboard refrigeration equipment have been described, water or other cooling fluid could be piped to the cooler. It is accordingly intended that the claims shall cover all such modifications and applications as do not depart from the true spirit and scope of the invention.

ELEMENT LIST

10 cooler
12 top panel
14 bottom panel
16 front panel
18 rear panel
20, 22 end panels
24 interior of water holding vessel
26 pockets
28 access panel
30 drain
32 cooler
34 top panel
36 bottom panel
38 pockets
40 access panel
42 drain

What is claimed is:

1. A cooler, comprising:

a base member having a polygonal configuration;

an upper member connected to said base member forming a vessel with an interior adapted to hold ice, said upper member having a crinkly surface with an access opening and plurality of pockets extending from said outer surface into said interior of said vessel, each pocket of said plurality of pockets having an outer surface contiguous with said crinkly surface and an inner surface in said interior of said vessel; and an access panel disposed over said access opening, said access panel providing access to ice in said interior of said vessel and providing access to said interior surfaces of said plurality pockets without disturbing said plurality of pockets, one of said base member and upper member containing a opening adapted to drain melted ice while said access panel is disposed over said access opening, said base member and upper member being double walled forming an insulated structure.

2. A cooler, comprising:

a bottom panel having a polygonal configuration with lateral and transverse edge portions;

a plurality of upright panels connected to said lateral and transverse edge portions and extending upward therefrom, said bottom panel and upright panels being double walled and forming an insulated vessel with an interior adapted to hold ice;

a double walled top panel having a top surface and plurality of pockets extending from said top surface into said interior of said vessel, each pocket of said plurality of pockets having a top surface contiguous with said top surface of said top panel and a bottom surface in said interior of said vessel; and an access panel disposed in one of said top and bottom panels, said access panel providing access to ice in said interior of said vessel and providing access to said bottom surfaces of said plurality of pockets, one of said bottom and top panels containing an opening adapted to drain melted ice without disturbing said access panel.

3. A cooler, comprising:

a bottom panel having a plurality of edge portions;

a sidewall connected to said bottom panel, said sidewall and bottom panel forming a vessel adapted to hold fluid, said sidewall having an access opening;

a top panel connected to said sidewall and spaced from said bottom panel, said top panel having a plurality of openings, said bottom panel, sidewall and top panel are double walled forming an insulated structure;

a plurality of pockets extending from said plurality of openings in said top panel into said interior, said plurality of pockets being integrally formed with said bottom panel, said pockets being spaced from one another and said sidewall forming interior cavities about said pockets adapted to hold fluid; and a removable cover panel for said access opening, said access panel providing access to fluid in said interior cavities of said vessel and providing access to said plurality of pockets without disturbing said plurality of pockets, one of said sidewall and bottom panel containing an opening adapted to drain fluid without removing said cover panel.

* * * * *